United States Patent [19]

Hart

[11] 4,131,865

[45] Dec. 26, 1978

[54] THREE POLE ELECTROMAGNET

[75] Inventor: John S. Hart, Racine, Wis.

[73] Assignee: Allen-Bradley Company, Milwaukee, Wis.

[21] Appl. No.: 843,463

[22] Filed: Oct. 19, 1977

[51] Int. Cl.[2] ..... H01F 7/08

[52] U.S. Cl. ..... 335/257; 335/277

[58] Field of Search ..... 335/255, 257, 258, 261, 335/271, 277, 279, 281

[56] References Cited

U.S. PATENT DOCUMENTS 2,239,267 4/1941 Jeffrey ..... 335/261

3,573,690 4/1971 Jones ..... 335/279

*Primary Examiner*—George Harris

*Attorney, Agent, or Firm*—Thad F. Kryshak

[57] ABSTRACT

An electromagnet having a stationary core and a movable armature, each having three pole faces, forms a magnetic circuit having three substantially parallel legs when the core and the armature are brought together. The center leg of the magnetic circuit includes a demagnetizing airgap combined with a non-magnetic coating on a center pole face, which coating is more resistant to wear than the material of the uncoated pole faces.

12 Claims, 4 Drawing Figures

THREE POLE ELECTROMAGNET

BACKGROUND OF THE INVENTION

The invention relates to a control relay for switching coil currents of contactors, starters and other control relays. More particularly, it relates to a relay of the type having a stationary core and a movable armature each having three pole faces that form three substantially parallel legs in a magnetic circuit; one of which is interrupted by a non-magnetic gap, commonly called an airgap.

In the past, it has been common practice in relays of this type to provide some means for preventing a complete closure of the airgap. The prior art reveals various forms of airgap maintenance including projections into the airgap from either the movable armature member or the stationary core member; a stationary stop member engageable by the movable armature or some portion of the mechanism connected to the armature, e.g., U.S. Pat. No. 1,697,953; and a wear resistant non-magnetic surface on the pole faces of the magnetic device, e.g., U.S. Pat. No. 2,239,267 and U.S. Pat. No. 3,573,690.

The airgap is included in a closed magnetic circuit to reduce the level of residual flux and force required to separate the armature and core upon de-energization of the coil.

SUMMARY OF THE INVENTION

It is the general object of the present invention to disclose a three pole magnetic structure in which the central leg of the three leg magnetic circuit is interrupted by a non-magnetic, hardened surface so that the airgap is preserved.

It is a further object to disclose an electromagnet which can provide a signal that the operating life of the magnet is nearly completed.

The present invention provides an electromagnet including a stationary core and a movable armature, each having three pole faces which form three substantially parallel legs of a magnetic circuit when the core and armature are brought together. In the preferred embodiment, the middle pole face of the armature includes a hard, non-magnetic tungsten carbide coating which provides a non-magnetic gap, commonly called an airgap, in the middle leg of the magnetic circuit. As the electromagnet nears the ends of its useful life, the uncoated pole faces of the outside legs of the magnetic circuit wear to a greater extent than the coated pole face and, as a result, the electromagnet tends to chatter when it closes. The chatter serves as a signal that the end of the useful life of the magnet is near and the structure should be replaced.

DESCRIPTION OF THE PREFERRED EMBODIMENT

Figure 1:
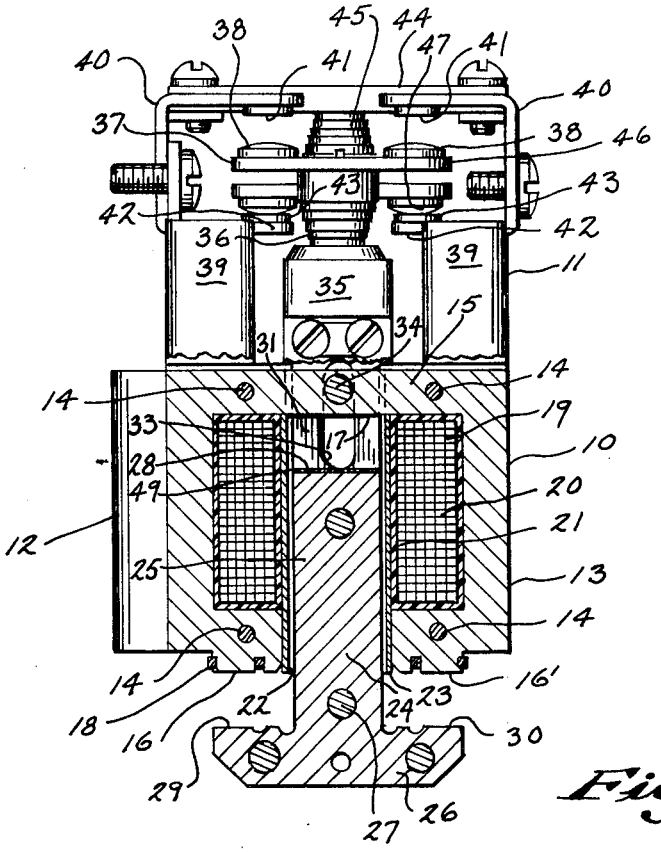
FIG. 1 is a detailed view, partly in section, of one type of a relay, incorporating the electromagnet of the present invention. The relay is shown in the open position.
Figure 3:
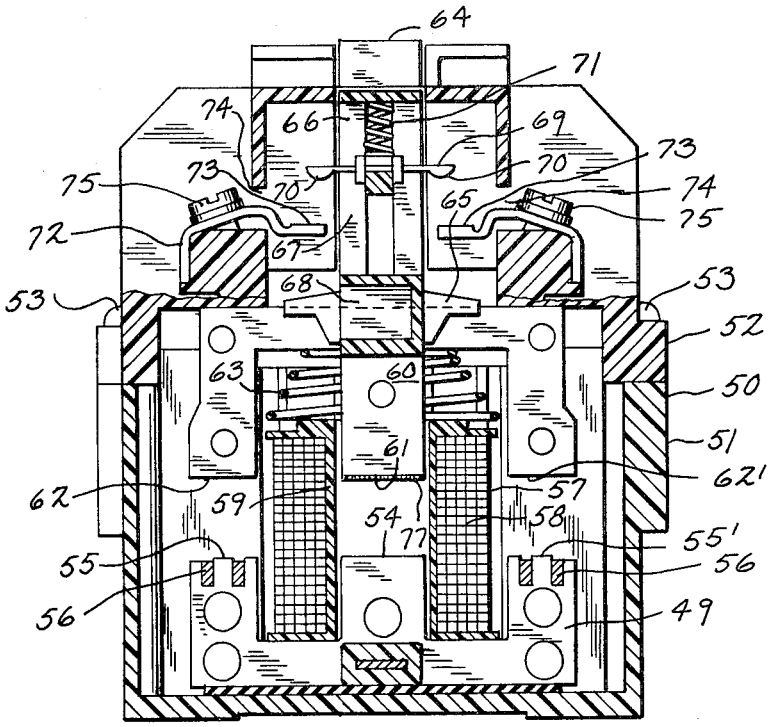
FIG. 3 is a detailed view, partly in section, of a second type of relay also incorporating the electromagnet of the present invention. The relay is shown in the opened position.

FIGS. 1 and 3 show two different configurations of a control relay including an electromagnet having a three-legged magnetic circuit. In both configurations an airgap is provided in the middle leg only, and in each the airgap includes a layer of a hard, non-magnetic coating on a pole face. In the preferred embodiment, the hard, non-magnetic coating is of tungsten carbide which is a non-magnetic material with much greater resistance to wear than the ferromagnetic material used to form the core and the armature.

In the first configuration, represented in FIG. 1, the control relay has a magnetic circuit section 10 and an electrical contact section 11 located above the magnetic circuit section 10. The magnetic circuit section 10 is contained in a housing 12, a side of which has been removed in FIG. 1 to show the parts of the magnetic circuit. The magnetic circuit includes a U-shaped core 13 made of a plurality of laminations of a ferromagnetic material. The core 13 is inverted and fixedly mounted in a housing 12. The laminations of the core are held together by rivets 14. The core 13 has a base member 15, two salient pole faces 16, 16' and a non-salient pole face 17. Shading rings 18 are embedded in the salient pole face 16, 16' to provide a lagging component of flux to insure quiet operation when operating on alternating current.

The magnetic circuit also includes a coil assembly 19 which is slidably inserted into the interior space of the U-shaped core 13. The coil assembly 19 includes a coil 20 and a coil casing 21; the coil assembly having a passageway 22 therethrough in which a liner 23 is slidably inserted. A T-shaped armature 24, having a stem 25 and a cross member 26 which is perpendicular to the stem 25 is slidably inserted upside down into the coil passageway 22 in contact with the liner 23. The armature 24 is made of laminations of a suitable ferromagnetic material, such as silicon steel, held together by rivets 27. A pole face 28 is formed at an upper end of the stem 25 and a pair of pole faces 29, 30 are formed on the cross member 26, one at each end. The ends of the cross member 26 are shaped so that the pole faces 29, 30 are parallel to pole face 28. Extending from the upper end of the stem 25 and pole face 28 is an armature blade 31 which is received in a slot 32 which extends through the base member 15 of the core 13. The blade 31 extends from the magnetic circuit section 10 into the electrical contact section 11. The armature blade 31 includes a channel 33 which cooperates with a pin 34 in the base member 15 to limit the movement of the armature blade 31.

As seen in FIG. 1, the electrical contact section 11 includes an upper normally open switch, and a lower normally closed switch. Although only one of each is shown any number of either type of switch may be used, the number being limited by the area for mounting the switches. Referring again to FIG. 1, it can be seen that a crossbar 35 is mounted on the portion of the armature blade 31 which extends into electrical contact section 11. Mounted on the crossbar 35 is a spring 36 which supports a movable contact bridging member 37 and contacts 38. A contact block 39 is mounted on the housing 12 and includes a pair of fixed, extended contact flanges 40 and a pair of fixed contacts 41. The spring 36 is sized so that when the armature blade 31 extends to its limit into the electrical contact section 11 the contacts 38 on the movable bridging member 37 are urged against the contacts 41 on the extended contact flanges 40. As seen in FIG. 1, the armature blade 31 is withdrawn and the switch is open. As the armature blade 31 is normally withdrawn, the switch just described is a normally open (N.O.) switch.

The relay seen in FIG. 1 also includes a lower normally closed or (N.C.) switch. The normally closed switch includes a pair of short contact flanges 42 mounted on a second side of contact block 39 to support a pair of fixed contacts 43. A spring support frame 44 which is mounted on the contact block 39 supports a spring 45 on which a bridging member 46 and a pair of contacts 47 are mounted. The spring 45 is sized so that the movable contacts 47 are urged against the fixed contacts 43 when the armature blade 31 is withdrawn. Crossbar 35 is provided with a projection, not shown in the drawings, which is urged against bridging member 46 when the armature blade 31 is fully extended into electrical contact section 11 thereby opening the normally closed switch.

When the coil 22 is not energized the armature 24 is held by gravity in the position seen in FIG. 1 in which the pole faces 29, 30 and pole face 28 are not in contact with salient pole faces 16, 16' and non-salient pole face 17 of the core 13. When coil 22 is energized, flux is induced in the three legs of the magnetic circuit and the armature 24 is lifted into contact with core 13. When this occurs each of the pole faces 16, 16' contacts a separate pole face 29 or 30 to form the two outside legs of the magnetic circuit. The outside legs are formed completely of ferromagnetic material.

Figure 2:
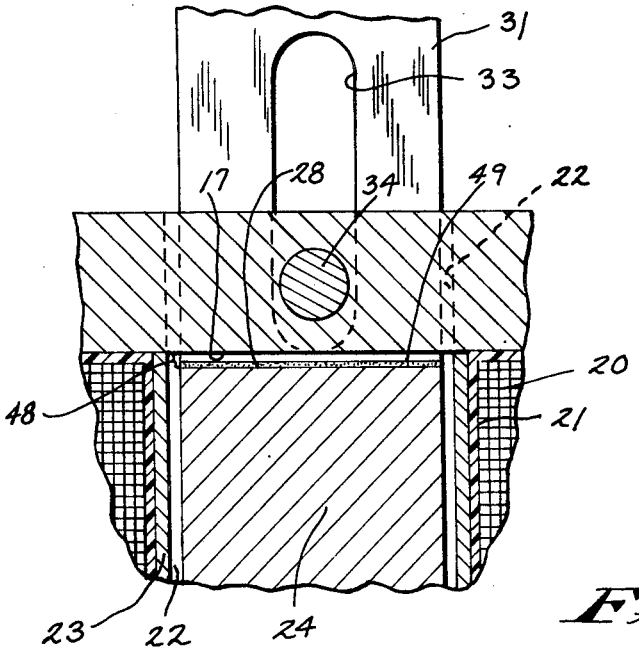
FIG. 2 is an enlarged view of that portion of the relay of FIG. 1 which includes the coated pole face of the center leg of the magnetic circuit. The pole faces of the center leg of the magnetic circuit are shown in the positions they assume when the relay is in the closed position.

Turning now to FIG. 2, it can be seen that when the relay is closed the third or middle leg of the circuit includes an airgap 48 between the pole face 28 and the non-salient pole face 17. The airgap 48 is provided to improve the separation of the armature 24 from the core 13 upon deenergization of the coil. An airgap is useful because in ferromagnetic materials the relationship between coil excitation and magnetic flux is non-linear and characterized by hystersis and after a cycle of energization and deenergization the material tends to retain residual flux, which is present will hinder the separation of the movable magnetic element from the stationary magnetic element. Air and many other materials exhibit an approximate linear relationship between coil excitation and flux.

In the relay shown in FIG. 2, the airgap 48 includes a hard, non-magnetic layer of tungsten carbide 49 which has been coated on the pole face 28 of the armature. Tungsten carbide which has approximately the same magnetic permeability as air, is more durable than the iron of the pole faces and thus resists wear for a longer period of time.

Returning to FIG. 1, it can be seen that the pole faces 16, 16' and 29, 30 which are in the outer legs of the magnetic circuit are not coated. While the pole faces 16, 16', 29 and 30 in the outer legs wear, the center pole face 28 does not. As a result, the airgap 48 is maintained throughout the life of the relay. When the relay is near the end of its life, wear in pole faces 16, 16', 29 and 30 produces additional airgaps of uneven length and size in the outside legs of the core. When a relay with badly worn pole faces is closed, the chatter which is heard as a result of the wear can be considered a signal to replace the relay.

Figure 4:
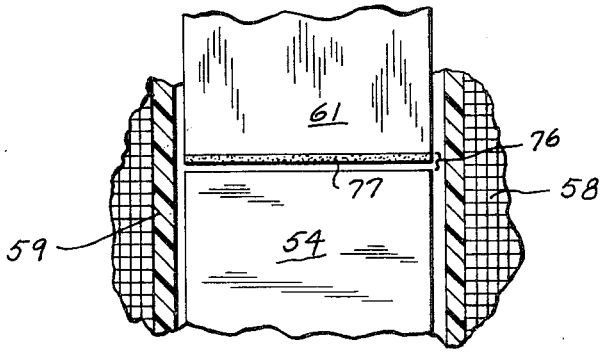
FIG. 4 is an enlarged view of that portion of the relay of FIG. 3 which includes the coated pole face of the center leg of the magnetic circuit. The pole faces of the center leg of the magnetic circuit are shown in the positions they assume when the relay is in the closed position.

In FIGS. 3 and 4, a second type of relay having a three-legged magnetic circuit is shown. The relay of FIGS. 3 and 4 includes an E-shaped core and an E-shaped armature.

As seen in FIG. 3, the E-shaped core 49 is made of laminations of ferromagnetic material and is secured in a housing 50 which has a lower section 51 and an upper section 52 fastened together by screws 53. The core 49 has a center pole face 54 and two end pole faces 55, 55'. The laminations are held together by rivets and further secured at the pole faces 55, 55' by shading rings 56. A coil assembly 57 is slidably positioned on the middle leg of the E core 49. The coil assembly 57 includes coil 58 which is wound around casing 59.

An E-shaped armature 60 having three pole legs that depend from a base member is positioned above the core 49 so that center pole face 61 and end pole faces 62, 62' oppose the pole faces 54 and 55, 55', respectively. An armature support coil spring 63 is positioned on a raised surface of the coil casing 59 and receives the middle pole of the armature 60 in the center of the coil. An actuator assembly 64 having a barrier 65 is mounted on armature 60. The actuator assembly 64 also has a plurality of rows of compartments, each row having three compartments 66, 67 and 68 in alignment with each other. As seen only in FIG. 3, a contact spaner 69 extends across the bottom of the upper compartment 66 and out to either side of the actuator assembly 64. On each extended end of the spaner 69 is a contact 70. The contact 70 faces downward, but is movable upward against a support spring 71. Although only a single pair of contacts 70 is shown, additional pairs of similar contacts could be included in other compartments, if desired.

Still referring to FIG. 3, it can be seen that the relay includes a plurality of stationary electrical connectors 72 each having a contact 73 formed at each end. The contacts 73 enter the upper section 52 of the housing 50 through vents 74 in a side wall. Each connector 72 has a wire terminal 75 which extends outside the upper section of the housing 52. FIG. 3 illustrates a plurality of normally open (N.O.) switches. In accordance with conventional practice, normally closed (N.C.) switches may be formed in the same relay. See Coker et al. U.S. Pat. No. 2,985,736, issued May 23, 1961.

When the coil is energized each of the pole faces 55, 55' is in contact with a different pole face 62, 62' to form the outside two legs of the magnetic circuit. The two outside legs are formed completely of ferromagnetic material. The third or center leg of the magnetic circuit includes an airgap between the pole face 54 and 61.

Turning now to FIG. 4, it can be seen that when the relay is closed an airgap 76 exists between the pole faces 54 and 61. The airgap 76 consists of an air space and the non-magnetic layer 77 of tungsten carbide which is coated on the pole face 61.

As the pole faces on the outside legs wear more quickly than the coated pole face in the center leg of the magnetic circuit, the airgap 76 of the center leg survives until the wear of the end legs results in a chatter which signals the need to replace the relay or the relay fails in an open position due to other causes.

In the preferred practice of the invention, the tungsten carbide layer is applied to the center pole face of the armature or core by the plasma flame spray process which produces coatings of superior quality. The plasma flame spray process requires a suitable plasma spray gun (e.g., Metco-Type 3MB available from Metco Inc., Westbury, Long Island, N.Y.). In the spray gun, D.C. current jumps the gap between a one piece nozzle and an all purpose electrode. The high intensity arc thus produced is confined with the gun and an inert gas (such as nitrogen/hydrogen or nitrogen/argon mixture) is also passed between the nozzle and the electrode. The arc "excites" the gas producing a thermal plasma with temperatures up to 30,000° F. Powdered tungsten carbide is metered into the gun in precise quantities by a power feed unit. The powder introduced into the thermal plasma is melted and projected upon the center pole face to form a hard, non-magnetic coating of high intensity. A more complete description of the plasma flame spray process and the equipment used in the process can be found in U.S. Pat. Nos. 2,960,594, 3,145,287 and 3,138,298. The application of tungsten carbide by the plasma flame spray process provides a significant advantage in that it does not necessitate any pretreatment of the pole faces prior to the application of the tungsten carbide as do other procedures.

In place of a tungsten coating other suitable hard, non-magnetic coatings can be used which can be applied by the plasma flame spray process or other suitable procedures. The coating applied to the center pole should be more resistant to wear than the materials making up the end leg pole faces. The coating of non-magnetic material is preferably about 0.001 to about 0.010 inches in thickness. The thickness of the coating will vary with the material of the coating and degree of wear of other components which is anticipated.

Although for purposes of illustration the invention has been described in connection with two specific control relays it will be apparent to those skilled in the art that the invention also can be used to advantages in other structures including solenoids which convert electromagnetic energy to mechanical energy. Representative of such solenoids are those described in U.S. Pat. No. 2,311,890.

The application of the non-magnetic hardened coating to only one or both of the center pole surfaces provides several unanticipated advantages. In addition to being less expensive than applying the coating to all pole faces it has been found as previously described that the use of the coating in only the center leg of the magnetic circuit of the magnet may provide a signal that the end of the useful life of the magnet is near. The signal is an audible "chatter" or clicking noise which can develop as a result of uneven wear of end pole faces.

These and other advantages of the present invention will be apparent to those skilled in the art. It will also be apparent to those skilled in the art that a number of variations, modifications and changes may be made without departing from the spirit and scope of the present invention. Therefore, it is intended that the invention not be limited to the description herein which was for purposes of illustration, but only by the claims which follow.

I claim:

1. An electromagnet, which includes:

a housing;

a stationary core of ferromagnetic material disposed within the housing, the core having a base and a pair of legs extending substantially perpendicular from the base, said core having a center pole face and a pole face at the end of each leg;

a movable armature of ferromagnetic material having a center pole face and two end pole faces, the armature being disposed in the housing opposite the core so that each pole face on the core is opposite a pole face on the armature;

an energizing coil associated with said core, so that when the coil is energized a magnetic force is induced which moves the armature from an open position to a closed position in which a three-legged magnetic circuit is formed; and a coating of non-magnetic material on a center pole face, so that when the coil is energized the end pole faces of the armature and core are in direct contact and the center pole faces are separated by an airgap which includes a non-magnetic coating, said coating being longer wearing then the material making up the end pole faces of the armature and core so that the end pole faces may wear more quickly than the coating on the center pole.

2. The electromagnet of claim 1 in which the coating is a tungsten carbide layer from about 0.001 to about 0.010 inches.

3. The electromagnet of claim 1 in which the coating is a tungsten carbide layer on the center pole face of the armature.

4. An electrical relay, which includes:

a housing;

a stationary core of ferromagnetic material disposed within the housing, the core having a base and a pair of legs extending substantially perpendicular from the base, said core having a center pole face and a pole face at the end of each leg;

a movable armature of ferromagnetic material having a center pole face and two end pole faces, the armature being disposed in the housing opposite the core so that each pole face on the core is opposite a pole face on the armature;

an energizing coil associated with said core, so that when the coil is energized a magnetic force is induced which moves the armature from an open position to a closed position in which a three leg magnetic circuit is formed;

a stationary pair of electrical contacts mounted on the housing;

a pair of electrical contacts connected to the movable armature; and a coating of non-magnetic material on a center pole face, so that when the coil is energized the end pole faces of the armature and core are in direct contact and the center pole faces are separated by an airgap that includes a non-magnetic coating, said coating being longer wearing then the material making up the end pole faces of the armature and core so that the end pole faces wear more quickly than the coating on the center pole.

5. An electrical relay as recited in claim 4, wherein:

the core is U-shaped including two salient pole faces, and a non-salient center pole face; and the armature is T-shaped.

6. A relay as recited in claim 4, wherein the core and the armature are both E-shaped.

7. The relay of claim 4 in which the coating is a tungsten carbide layer from about 0.001 to about 0.010 inches.

8. The relay of claim 6 in which the coating is a tungsten carbide layer from about 0.001 to about 0.010 inches.

9. The electromagnet of claim 5 in which the tungsten carbide coating is on the center pole face of the armature.

10. The relay of claim 6 in which the tungsten carbide coating is on the center pole face of the armature.

11. The relay of claim 2 in which the tungsten carbide coating has been applied to the center pole face by the plasma flame spray process.

12. The relay of claim 8 in which the tungsten carbide coating has been applied to the center pole face by the plasma flame spray process.

* * * * *